US011788713B2

(12) United States Patent
Huang et al.

(10) Patent No.: US 11,788,713 B2
(45) Date of Patent: Oct. 17, 2023

(54) FLOWER-STRUCTURED, DYNAMIC, DECORATIVE LAMP

(71) Applicants: Guangdong Minglun Optoelectronics Technology Co., Ltd., Dongguan (CN); Guangquan Huang, Dongguan (CN)

(72) Inventors: Guangquan Huang, Dongguan (CN); Yiqun Xu, Dongguan (CN)

(73) Assignees: Guangdong Minglun Optoelectronics Technology Co., Ltd., Dongguan (CN); Guangquan Huang, Dongquan (CN)

( * ) Notice: Subject to any disclaimer, the term of this patent is extended or adjusted under 35 U.S.C. 154(b) by 0 days.

(21) Appl. No.: 17/958,224

(22) Filed: Sep. 30, 2022

(65) Prior Publication Data

US 2023/0184413 A1 Jun. 15, 2023

(30) Foreign Application Priority Data

Dec. 9, 2021 (CN) ..... 202111513977.X
Apr. 20, 2022 (CN) ..... 202210424202.3
Apr. 20, 2022 (CN) ..... 202220933118.X

(51) Int. Cl.
*F21V 19/02* (2006.01)
*F21V 21/108* (2006.01)
(Continued)

(52) U.S. Cl.
CPC ..... *F21V 19/02* (2013.01); *F21V 21/108* (2013.01); *F21V 23/023* (2013.01); *F21W 2121/00* (2013.01)

(58) Field of Classification Search
CPC ..... F21V 19/02; A41G 1/002
See application file for complete search history.

(56) References Cited

U.S. PATENT DOCUMENTS 6,389,718 B1 * 5/2002 Joo ..... A41G 1/002 40/412
2010/0097790 A1 * 4/2010 Tseng ..... F21K 9/00 362/122

(Continued)

FOREIGN PATENT DOCUMENTS

CN 201954360 * 8/2011 ..... F21S 6/00
CN 106852524 * 6/2017 ..... A41G 1/00

(Continued)

OTHER PUBLICATIONS

English Machine Translation of CN 112248411 provided by Espacenet (Year: 2021).*

(Continued)

*Primary Examiner* — Zheng Song

(57) ABSTRACT

The present invention relates to a flower-structured, dynamic, decorative lamp, at least three the sliding arms are hinged at the pivot section of the sliding support through a restricting member in the form of being separated by an angle from each other, and that in the case of simulating the opening of petal structure, the sliding arms can change the angle made with the limiting rest by the movement of the sliding rod connected to the sliding support in the direction of its own axis. One end of the sliding rod is connected to the sleeving section of the sliding support and the other end is connected to a damper device or a power transmission device that drives the sliding rod pass through the center of the limiting rest to move the sliding support.

19 Claims, 5 Drawing Sheets

(51) Int. Cl.
*F21V 23/02* (2006.01)
*F21W 121/00* (2006.01)

(56) References Cited

U.S. PATENT DOCUMENTS

| | | | | |
|---|---|---|---|---|
| 2012/0121826 | A1* | 5/2012 | Marlow | A41G 1/001 428/24 |
| 2013/0078395 | A1* | 3/2013 | Krivanek | A41G 1/002 428/26 |
| 2016/0311488 | A1* | 10/2016 | Teitel | F21S 9/02 |

FOREIGN PATENT DOCUMENTS

| | | | | |
|---|---|---|---|---|
| CN | 109506184 | * | 9/2017 | F21S 9/035 |
| CN | 108644646 | * | 10/2018 | F21V 19/001 |
| CN | 112248411 | * | 9/2020 | B29C 51/30 |
| CN | 214016195 | * | 8/2021 | A41G 1/00 |
| CN | 217482666 | * | 9/2022 | F21V 3/02 |
| JP | 2004200136 | * | 6/2003 | F21V 35/00 |
| WO | WO 99/66256 | * | 6/1999 | F21S 8/00 |

OTHER PUBLICATIONS

English Machine Translation of CN 108644646 provided by ESPACENET (Year: 2018).*

* cited by examiner

FLOWER-STRUCTURED, DYNAMIC, DECORATIVE LAMP

BACKGROUND OF THE INVENTION

Technical Field

The present application relates to technical field of decorative lamps, and more particularly to a flower-structured, dynamic, decorative lamp.

Description of Related Art

Various decorative lamps are popular in marketplaces to satisfy people who pursue quality life. Flower-shaped lamps represent one class of decorative lamps.

China Patent Publication No. CN107747721A discloses a flower-shaped LED lamp that is easy to assemble and disassemble. The known lamp has a heat-dissipating casing and an LED light socket for receiving an LED light, and the LED light socket is provided with a jack. The lamp also has a spring bolt that is installed with a petal-shaped holding plate at one side thereof. The petal-shaped holding plate has its one side provided with a retaining plate. The petal-shaped holding plate and the retaining plate are joined at the spring bolt, which controls the retaining plate to open and close. By pressing the petal-shaped holding plate downward, the retaining plate is lift by the spring bolt so that a gap is formed. Through the gap, the LED light can be installed into the LED light socket, thereby accomplishing assembly of the LED light. Then the petal-shaped holding plate can be released to lower the retaining plate so that one end of the retaining plate is fit in a recess formed on the LED light casing to prevent the LED light from coming off. The petal-shaped holding plates and the retaining plate are each provided at a number of six to be installed at the six surfaces of the heat-dissipating casing, thereby forming a flower-like structure.

China Patent Publication No. CN103330313A provides a luminous simulation flower using dye-sensitized solar cell as power supply, which belongs to the application technical field of solar lighting. The luminous simulation flower comprises the dye-sensitized solar cell, an electric wire, a photovoltaic controller, a storage battery, a photosensitive automatic switch, a light-emitting diode (LED) lamp, a flowerpot, a mounting box, a filler, a hollow strut, decorative leaves and a flower. In daytime, sunshine irradiates the flower which is made of the dye-sensitized solar cell; the dye-sensitized solar cell generates currents; the currents are input into the photovoltaic controller to be adjusted through the electric wire, and are input into the storage battery to be stored; at night, with the change of light rays, the photosensitive automatic switch automatically connects a circuit between the storage battery and the LED lamp; the storage battery outputs the current to supply power to the LED lamp; and the LED lamp gives out lights, so that the flower shines in the night.

Most existing flower-shaped decorative lamps are static as they use fixed petals to screen a light source. It is impossible for these known lamps to have their petals open and close automatically. To address the shortcomings of the prior art, the present invention provides a flower-structured, dynamic, decorative lamp in the art that simulates a blooming flower when operated.

In addition, on the one hand, due to the differences in the understanding of those skilled in the art; on the other hand, due to the fact that the applicant studied a large amount of literature and patents when putting the invention, but space limitations do not allow all the details and content are described in detail, however, this does not mean that the invention does not have these prior art features, on the contrary, the present invention already has all the features of the prior art, and the applicant reserves the right to add relevant prior art to the background technology.

SUMMARY OF THE INVENTION

To address the shortcomings of the prior art, the present invention provides a flower-structured, dynamic, decorative lamp, comprising at least two layers of petal structures arranged as an inner layer and an outer layer and at least one lamp bead. When the inner-layer petal structure is closed, the lamp bead is enclosed radically inside the inner-layer petal structure. The at least two, inner-layer and outer-layer, petal structures are mounted around a stem via their respective sliding sleeves in a manner that the petal structures are coaxial about an axis Z and allowed to slide upward and downward. When the petal structures are assembled, the sliding sleeve of the inner-layer petal structure is located above the sliding sleeve of the outer-layer petal structure in a direction of the axis Z. A petal posing mechanism is mounted around the stem coaxially with the respective sliding sleeves of the two, inner-layer and outer-layer, petal structures about an axis Z such that the petal posing mechanism axially upward resists gravitation of the at least two, inner-layer and outer-layer, petal structures, wherein the petal posing mechanism changes a separation level of all petals hinged at the sliding sleeve of at least the outer-layer petal structure by sliding along the stem with respect to the sliding sleeve of the outer-layer petal structure, wherein the relative sliding between the petal posing mechanism and the sliding sleeve can be driven by a damper device or a power transmission device.

Preferably, the flower-structured, dynamic, decorative lamp, comprises at least first petal-shaped tabs, first sliding arms, second sliding arms, second petal-shaped tabs, two sliding sleeves, a lamp bead, a petal posing mechanism, a damper device and a power transmission device. The two sliding sleeves are respectively connected to a number of the first sliding arms and a number of the second sliding arms to form an outer-layer petal and an inner-layer petal. The first petal-shaped tabs and the second petal-shaped tabs are connected to the first sliding arms and the second sliding arms respectively to form a single petal of the outer-layer petal and a single petal of the inner-layer petal. The lamp bead is used to simulate flower stamens and provide illumination. The damper device or the power transmission device is used to power simulation of blooming of a real-world flower. The petal posing mechanism is used to provide a connection channel between the sliding sleeve in the outer-layer petal and the damper device or the power transmission device, and to limit the movement of the first sliding arms.

The sliding sleeve is in the form of a column, and the directional axis Z is established with the axis where the sliding sleeve is located. The sliding sleeve is formed by a sleeving section, a pivot section, and an upper connector. The plural first sliding arms or the plural second sliding arms are connected to the pivot section, wherein the first sliding arm or the second sliding arm has first sliding arm connectors or second sliding arm connectors hinged in the form of being arranged coplanarly and separated by an angle from each other to the pivot section of the sliding sleeve through a restricting member, so as to form the outer-layer petal structure or the inner-layer petal structure. The upper connector of the sliding sleeve in the inner-layer petal structure is for receiving the lamp bead, and the sleeving section of the sliding sleeve in the inner-layer petal structure is connected to the upper connector of the sliding sleeve in the outer-layer petal structure, so that the lamp bead, the outer-layer petal structure, and the inner-layer petal structure jointly form a flower-like structure.

The sleeving section of the sliding sleeve in the outer-layer petal structure is for receiving the damper device or the power transmission device, so that the damper device or the power transmission device drives the sliding sleeve to move along the axis Z. The petal posing mechanism is a hemispherical housing, and has its vertex provided with a through hole for enabling connection between the damper device or a power transmission device and the sliding sleeve of the outer-layer petal structure. The petal posing mechanism has its periphery contacting a middle portion of each said first sliding arm.

The first sliding arms are hinged at one end of the pivot section when the damper device or the power transmission device drives the two sliding sleeves to move along the axis Z so that the first sliding arm connectors move with the sliding sleeves while free ends of the first sliding arms move reversely to the sliding sleeves, leading to change of an included angle between each said first sliding arm and the petal posing mechanism in a plane defined by a contact point therebetween and the axis Z, and leading to change of a position of each said first petal-shaped tab connected with a respective said sliding arm, thereby allowing the outer-layer petal structure to simulate opening and closing actions of outer-layer petals of a real-world flower.

The second sliding arm is such hinged at one end of the pivot section that the second sliding arm connector moves with the sliding sleeve, so that when the outer-layer petal structure simulates the opening and closing actions of outer-layer petals of a real-world flower, the sliding sleeve in the inner-layer petal structure moves with the sliding sleeve in the outer-layer petal structure. In the case where the outer-layer petal structure simulates the closing of the outer-layer petal structure, the second petal-shaped tabs connected with the second sliding arm contacts and is constrained by the first petal-shaped tabs, causing the outer-layer petal structure closed. In the case where the outer-layer petal structure simulates the opening of the outer-layer petal structure, the second petal-shaped tabs connected with the second sliding arm disengages from contact with the first petal-shaped tabs and and falls under the action of gravity, causing the inner-layer petal structure to disperse, thereby simulating the opening of the inner-layer petal structure. In the case where the damper device or the power transmission device drives the two sliding sleeves to move away from the petal posing mechanism along the axis Z, the outer-layer petal structure and the inner-layer petal structure are able to simulate the opening of petal structure together, and the opening of the inner-layer petal structure is later than that of the outer-layer petal structure.

At least three sliding arms are hinged at the pivot section of the sliding support through a restricting member in the form of being separated by an angle from each other, and that in the case of simulating the opening of petal structure, the sliding arms can change the angle made with the limiting rest by the movement of the sliding rod connected to the sliding support in the direction of its own axis. One end of the sliding rod is connected to the sleeving section of the sliding support and the other end is connected to a damper device or a power transmission device that drives the sliding rod pass through the center of the limiting rest to move the sliding support.

According to a preferred embodiment, the sliding sleeve at least comprises a sliding sleeve connected to the outer-layer petal structure and sliding sleeve connected to the inner-layer petal. The sliding sleeve connected to the inner-layer petal structure and the sliding sleeve connected to the outer-layer petal structure are connected. The sliding sleeve connected to the outer-layer petal structure can be connected to the sliding rod. The sliding arm at least comprises a first sliding arm hinged at the sliding sleeve connected to the outer-layer petal structure and a second sliding arm hinged at the sliding sleeve connected to the inner-layer petal. In the process of simulating the opening of petal structure, the first sliding arms change the included angle they form with the petal posing mechanism so that the restriction provided by the first petal-shaped tabs to the second petal-shaped tabs attached to the second sliding arms changes.

Preferably, in the process where the damper device or the power transmission device drives the sliding rod to move, the first sliding arm at least has an open position, an over-blooming position, and a closed position. Preferably, the flower-structured, dynamic, decorative lamp the present invention is made to simulate the whole process where a bud blooms into a flower. Preferably, when the flower-structured, dynamic, decorative lamp of the present invention simulates a bud, the first sliding arm is in its closed position. When the flower-structured, dynamic, decorative lamp of the present invention simulates the fully bloomed flower, the first sliding arm is in its over-blooming position. Preferably, in the process where the lamp simulates a flower from its closed state to its fully bloomed state, the first sliding arm is in its open position.

Preferably, an electromagnetic levitation device is included to control the first sliding arms and the second sliding arms. Preferably, the effects of electromagnetic levitation prevent the second petal-shaped tabs attached to the second sliding arms from changing posture under the gravitational effects of the second sliding arms and of the second petal-shaped tabs as well as the restriction from the first petal-shaped tabs attached to the first sliding arms, causing posing unnaturally as they become over separated before the first petal-shaped tabs are fully separated and thus failing to simulate the full blooming process of a flower.

According to a preferred embodiment, the petal posing mechanism is connected to a casing of the damper device or the power transmission device through the stem, wherein the stem defines a space for accommodating the sliding rod, and remains connected with the damper device or the power transmission device when the damper device or the power transmission device drives the sliding rod to move, so that relative displacement happens between the sliding rod and the petal posing mechanism.

Preferably, when the sliding rod comes close to the sliding sleeve connected with the outer-layer petal structure, the first sliding arms are switched to the separated state from the gathered state. The first petal-shaped tabs attached to the first sliding arms move with the first sliding arms, thereby making the outer-layer petal structure open. When the first petal-shaped tabs start to simulate the opening action of the outer-layer petals of a flower, the first petal-shaped tabs separate from the second petal-shaped tabs attached to the second sliding arm, so that the second petal-shaped tabs are released from restriction of the first petal-shaped tabs. When becoming independent of the first petal-shaped tabs, the second petal-shaped tabs shift from the separated state to the gathered state due to the gravitation of the second sliding arm, thereby simulating the opening action of inner-layer petals of a flower.

Preferably, the blooming process of a flower is simulated by at least four successive states, namely (1) the outer-layer petal structure open and the inner-layer petal structure closed, (2) both the outer-layer petal structure and the inner-layer petal structure open, (3) the outer-layer petal structure over open and the inner-layer petal structure normally open, and (4) both the outer-layer petal structure and the inner-layer petal structure over open. Preferably, the four states represent the about-to-bloom state, the early blooming state, the fully blooming state, and the over blooming state of a flower, respectively. Preferably, the present invention uses an electromagnetic levitation device to control the first sliding arms 104 and the second sliding arms to simulate different blooming states of a flower.

Preferably, the blooming state of a flower is implemented as below. The electromagnetic levitation device sizes a magnetic force it applies to the second sliding arms according to the position of the first sliding arms, so as to control the states of the second petal-shaped tabs, thereby simulating different blooming states of a flower.

Preferably, when simulating the about-to-bloom state of a flower, that is, when the present invention simulates the state that the outer-layer petal structure open and the inner-layer petal structure closed, the first sliding arms shift to the open position from the closed position. When the first sliding arms are in their open position, the electromagnetic levitation device is in its first state in which it holds the second sliding arms still. In its first state, the electromagnetic levitation device generates a levitation force that is sufficient to cancel the acting force that makes the second sliding arms and the second petal-shaped tabs enter the open state from the closed state. Preferably, the acting force that makes the second sliding arms and the second petal-shaped tabs enter the open state from the closed state or makes the second sliding arms and the second petal-shaped tab move is the component force of its gravitation in its moving direction.

Preferably, when simulating the early blooming state of a flower, that is, when the present invention simulates the state that both the outer-layer petal structure and the inner-layer petal structure open, the first sliding arms are in their open position, and the electromagnetic levitation device is in its second state. Preferably, in its second state, the electromagnetic levitation device first reduces the levitation force it generates so that the levitation force is smaller than the acting force that makes the second sliding arms and the second petal-shaped tabs enter the open state from the closed state, thereby allowing the second petal-shaped tabs to enter the open state from the closed state. Preferably, before the second petal-shaped tabs enter the open state, the electromagnetic levitation device increases the levitation force it generates to cancel the acting force that makes the second sliding arms and the second petal-shaped tabs move, and when the second petal-shaped tabs enter the open state, the electromagnetic levitation device increases the levitation force it generates so that the second petal-shaped tabs can stop at the open position.

Preferably, when simulating a fully blooming state of a flower, that is, when the present invention simulates the state that the outer-layer petal structure over open and the inner-layer petal structure normally open, the first sliding arms 104 shift from the open position to the over-blooming position. For the disclosed lamp to simulate a fully blooming flower, the electromagnetic levitation device is in its third state. At this time, the levitation force generated by the electromagnetic levitation device can cancel the acting force that makes the second sliding arms and the second petal-shaped tabs move, thereby allowing the second petal-shaped tabs to keep the open state.

Preferably, when simulating the over blooming state of a flower, that is, when the present invention simulates the state that both the outer-layer petal structure and the inner-layer petal structure over open, the first sliding arms are in the over-blooming position. At this time, the electromagnetic levitation device is in its fourth state. Preferably, in its fourth state, the electromagnetic levitation device generates a reduced levitation force, so that the second petal-shaped tabs enter the over-open state form the open state.

Preferably, the electromagnetic levitation device adjusts the levitation force by detecting the position of the first sliding arms, so as to control the position of the second petal-shaped tabs, thereby simulating different blooming states of a flower.

According to a preferred embodiment, the damper device at least comprises a sliding shaft, a spring, and damping grease, wherein the damping grease applied to a surface of the sliding shaft serves to retards movement of the sliding shaft when the spring performs restorable deformation, so that the sliding rod connected with the sliding shaft has its movement limited in speed.

According to a preferred embodiment, the power transmission device at least comprises an electric motor and a transmission frame, in which the transmission frame is connected with a lower base cover, and the electric motor has its output shaft connected with a threaded bar which is further connected with a sliding nut support, while the sliding rod is connected to the sliding nut support so as to form a lifting structure that endows the sliding rod with a lifting property.

According to a preferred embodiment, the damper device is connected to a base to support the flower-structured, dynamic, decorative lamp, in which the damper device and the sliding rod are connected together and then enclosed inside the casing, so that with the damper device connected to the base, a protuberance provided on the casing gets engaged with a recess in a socket provided on the base.

According to a preferred embodiment, when the protuberance of the casing fits in the recess of the base, a tongue formed on the casing is in contact with a spring sheet installed in the socket of the base to form a feed path, so that the battery box installed inside the base can power the lamp bead installed in the flower-simulating lamp.

According to a preferred embodiment, the spring mounted on damper device is connected with an adjusting cap, so that when the casing encloses the damper device, the spring, the adjusting cap, and the casing jointly form a springiness adjusting mechanism for adjusting an initial spring force of the spring of the damper device.

According to a preferred embodiment, the electric motor is installed in the lower base cover and connected to the transmission frame to jointly form the power transmission device, and the lower base cover is connected to an upper base cover to enclose the power transmission device and support the flower-structured, dynamic, decorative lamp. Preferably, the upper base cover is the casing of the damper device.

According to a preferred embodiment, in the case that the damper device is employed to drive the sliding rod, the sliding rod is provided at an end close to the damper device with a pressing lever on which a user can exert a force, thereby make the spring perform plastic deformation.

According to a preferred embodiment, at least three the sliding arms are hinged at the pivot section of the sliding support through a restricting member in the form of being separated by an angle from each other, and that in the case of simulating the opening of petal structure, the sliding arms can change the angle made with the limiting rest by the movement of the sliding rod connected to the sliding support in the direction of its own axis. One end of the sliding rod is connected to the sleeving section of the sliding support and the other end is connected to a damper device or a power transmission device that drives the sliding rod pass through the center of the limiting rest to move the sliding support.

According to a preferred embodiment, the sliding support comprises at least a first sliding support and a second sliding support, wherein the second sliding support is connected to the first sliding support, and the first sliding support can be connected to the sliding rod; the sliding arm comprises at least a first sliding arm hinged on the first sliding support and a second sliding arm hinged on the second sliding bracket; in the case of performing the simulation of blooming, the first sliding arm changes the angle made with the limiting rest so that the restriction of the first petal-shaped tabs mounted on the first sliding arm to the second petal-shaped tabs mounted on the second sliding arm is changed.

Preferably, in the process where the damper device drives the sliding rod to move, the first sliding arm at least has an open position, a withered position, and a closed position. Preferably, the openable and closable flower-structured light-emitting device of the present invention is made to simulate the whole process where a bud blooms into a flower. Preferably, when the openable and closable flower-structured light-emitting device of the present invention simulates a bud, the first sliding arm is in its closed position. When the openable and closable flower-structured light-emitting device of the present invention simulates the fully bloomed flower, the first sliding arm is in its withered position. Preferably, in the process where the device simulates a flower from its bud state to its fully bloomed state, the first sliding arm is in its open position.

According to a preferred embodiment, the limiting rest is connected to a casing of the damper device or the power transmission device through the stem, and the stem defines a space for accommodating the sliding rod, and remains connected with the damper device or the power transmission device when the damper device or the power transmission device drives the sliding rod to move, so that relative displacement happens between the sliding rod and the limiting rest.

Preferably, when the sliding rod comes close to the sliding sleeve connected with the outer-layer petal structure, the first sliding arms are switched to the separated state from the gathered state. The first petal-shaped tabs attached to the first sliding arms move with the first sliding arms, thereby making the outer-layer petal structure open. When the first petal-shaped tabs start to simulate the opening action of the outer-layer petals of a flower, the first petal-shaped tabs separate from the second petal-shaped tabs attached to the second sliding arm, so that the second petal-shaped tabs are released from restriction of the first petal-shaped tabs. When becoming independent of the first petal-shaped tabs, the second petal-shaped tabs shift from the separated state to the gathered state due to the gravitation of the second sliding arm, thereby simulating the opening action of inner-layer petals of a flower.

According to a preferred embodiment, the damper device at least comprises a sliding shaft, a spring, and damping grease, wherein the damping grease applied to a surface of the sliding shaft serves to retards movement of the sliding shaft when the spring performs restorable deformation, so that the sliding rod connected with the sliding shaft has its movement limited in speed.

According to a preferred embodiment, the power transmission device at least comprises an electric motor and a transmission frame, in which the transmission frame is connected with a lower base cover, and the electric motor has its output shaft connected with a threaded bar which is further connected with a sliding nut support, while the sliding rod is connected to the sliding nut support so as to form a lifting structure that endows the sliding rod with a lifting property.

According to a preferred embodiment, the damper device is connected to a base to support the openable and closable flower-structured light-emitting device, in which the damper device and the sliding rod are connected together and then enclosed inside the casing, so that with the damper device connected to the base, a protuberance provided on the casing gets engaged with a recess in a socket provided on the base.

According to a preferred embodiment, when the protuberance of the casing fits in the recess of the base, a tongue formed on the casing is in contact with a spring sheet installed in the socket of the base to form a feed path, so that the battery box installed inside the base can power the lamp bead installed in the flower-simulating lamp. Preferably, the light source is provided on the pistil, and the power supply wiring of the light source is connected to the battery box from the center of the pivot section of the sliding support.

According to a preferred embodiment, the spring mounted on the damper device is connected with an adjusting cap, so that when the casing encloses the damper device, the spring, the adjusting cap, and the casing jointly form a springiness adjusting mechanism for adjusting an initial spring force of the spring of the damper device.

According to a preferred embodiment, the electric motor is installed in the lower base cover and connected to the transmission frame to jointly form the power transmission device, and the lower base cover is connected to an upper base cover to enclose the power transmission device and support the openable and closable flower-structured light-emitting device. Preferably, the upper base cover is the casing of the damper device.

According to a preferred embodiment, in the case that the damper device is employed to drive the sliding rod, the sliding rod is provided at an end close to the damper device with a pressing lever on which a user can exert a force, thereby make the spring perform plastic deformation.

The present invention provides an openable and closable flower-structured light-emitting device that at least has the following advantages:

(1) By having the sliding support connected to sliding arms that drive petal-shaped tabs to move, having the sliding arm spaced by an angle and hinged at the pivot section of the sliding support through the restricting member, and having the feed wiring for the light source connected to the battery box from the center of the pivot section of the sliding support, the present invention accomplishes the flower-simulating opening and closing actions without blocking light radiated from the light source;

(2) By having the damper device that uses the damping grease to retard restoration of the spring and thereby slow down movement of the sliding rod, the present invention can provide a longer blooming process for enhanced ornamental effects as compared to the prior art, and by including the adjusting cap that allows adjustment of the initial spring force of the spring of the damper device, the present invention is more adaptive to operating forces from different users; and (3) By using the power transmission device to drive the openable and closable flower-structured light-emitting device to adjust the initial postures of the petal-shaped tabs, and by changing the rotational speed of the electric motor, the present invention can provide various, dynamic flower-simulating opening speeds.

DETAILED DESCRIPTION OF THE INVENTION

Figure 1:
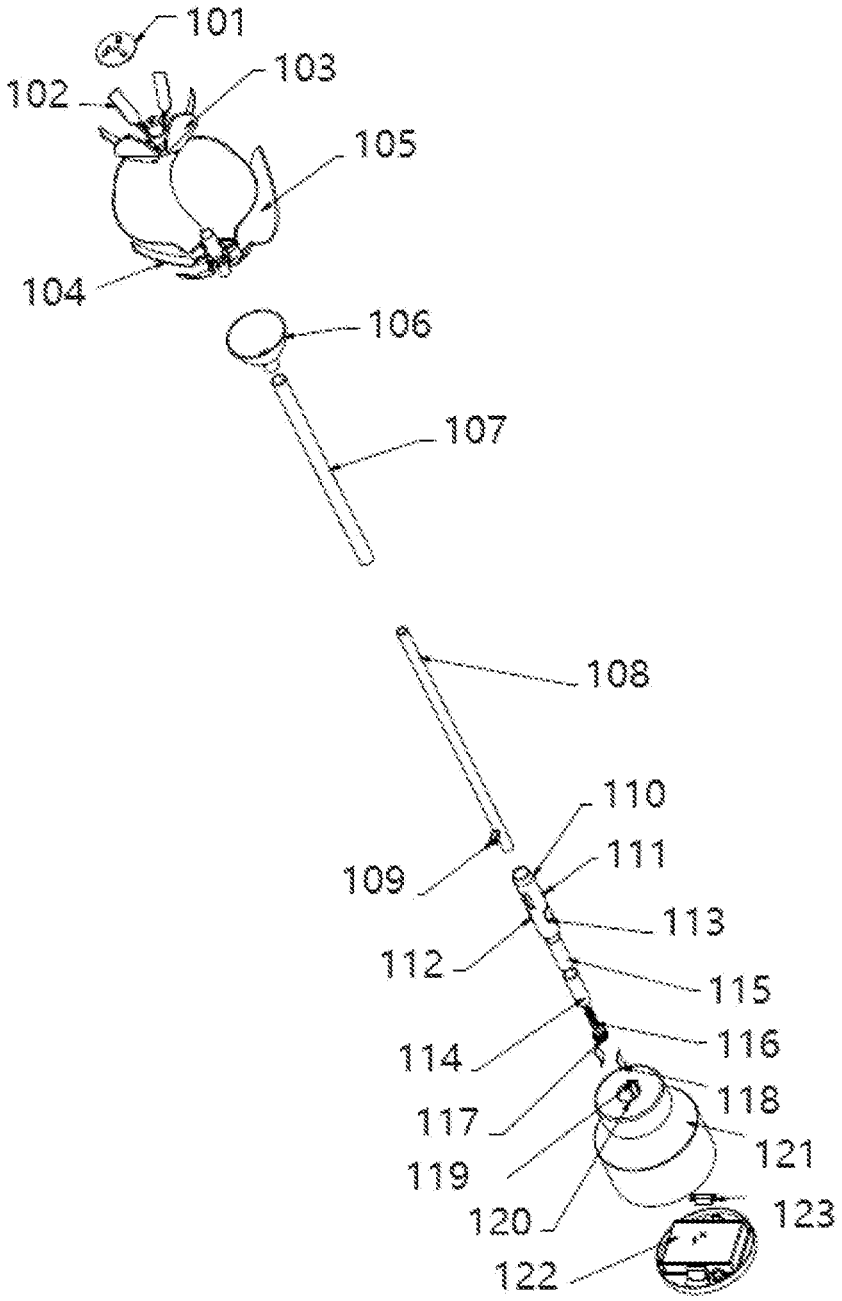
FIG. 1 is an exploded view of a flower-structured, dynamic, decorative lamp having a damper device as disclosed in the present invention.

The invention will be detailed by reference to FIG. 1 through FIG. 7. The present invention is basically about encircling a lamp bead with petal-shaped tabs that are attached to sliding arms, and having the sliding arms connected to sliding sleeves, so that a damper device or a power transmission device can drive the sliding sleeves to move and in turn open or close the petals. The flower-structured, dynamic, decorative lamp of the present invention is compact, easy to maintain, and inexpensive to manufacture, making it perfect for daily living occasions.

Embodiment 1

To address the shortcomings of the prior art, the present invention provides a flower-structured, dynamic, decorative lamp 100. The flower-structured, dynamic, decorative lamp 100 comprises at least two layers of petal structures arranged as an inner layer and an outer layer, and at least one lamp bead. When the inner-layer petal structure is closed, the lamp bead is enclosed radically inside the inner-layer petal structure. The at least two inner-layer and outer-layer petal structures are mounted around a stem 107 via their respective sliding sleeves 136 in a manner that the petal structures are coaxial about an axis Z 130 and allowed to slide upward and downward. When the petal structures are assembled, the sliding sleeve 136 of the inner-layer petal structure is located above the sliding sleeve 136 of the outer-layer petal structure in a direction of the axis Z 130.

A petal posing mechanism 106 is mounted around the stem 107 coaxially with the respective sliding sleeves 136 of the two inner-layer and outer-layer petal structures about an axis Z 130 such that the petal posing mechanism 106 axially upward resists gravitation of the at least two inner-layer and outer-layer petal structures. Therein, the petal posing mechanism 106 changes a separation level of all petals hinged at the sliding sleeve 136 of at least the outer-layer petal structure by sliding along the stem 107 with respect to the sliding sleeve 136 of the outer-layer petal structure. Preferably, relative sliding between the petal posing mechanism 106 and the sliding sleeve 136 can be driven by a damper device or a power transmission device.

Preferably, the outer-layer petal structure is formed by connecting a plurality of first sliding arms 104 connected with first petal-shaped tabs 105 to one sliding sleeve 136, and the inner-layer petal structure is formed by connecting a plurality of second sliding arms 102 connected with second petal-shaped tabs 103 to the other sliding sleeve 136. The petal posing mechanism 106 is a hemispherical housing. The petal posing mechanism 106 has its periphery contacting a middle portion of each said first sliding arm 104. The petal posing mechanism 106 has its vertex provided with a through hole for enabling connection between the sliding sleeve 136 of the outer-layer petal structure and the damper device or a power transmission device that powers simulation of blooming dynamics of a real-world flower.

Preferably, the damper device is such configured to drive the two sliding sleeves 136 to move away from the petal posing mechanism 106 along the axis Z 130 in the process of simulation of a blooming flower.

Referring to FIG. 1, at least three sliding arms are spaced by an angle and they are hinged at the pivot section 124 of the sliding sleeve 136 through a restricting member. For the lamp to simulate a blooming flower, when the sliding rod 108 connected with the sliding sleeve 136 moves along its own axis, the included angle between each of the sliding arms and the petal posing mechanism 106 changes. The sliding rod 108 has its one end connected to the sleeving section 125 of the sliding sleeve 136, and has its opposite end connected to a damper device that drives the sliding rod 108 passing through the petal posing mechanism 106 to drive the sliding sleeves 136 to move.

Figure 2:
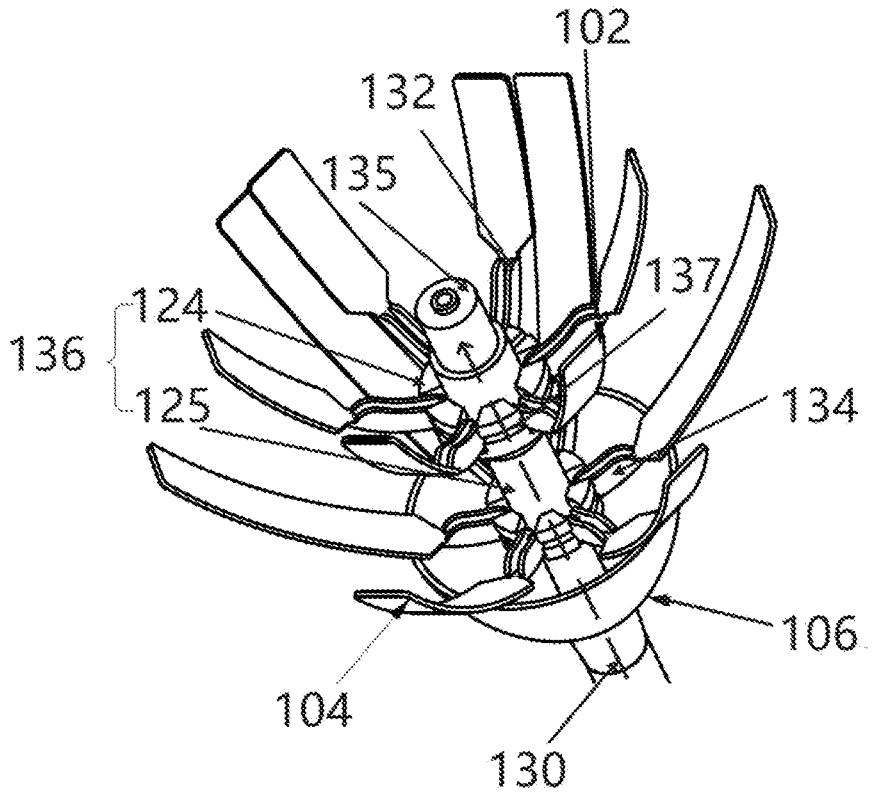
FIG. 2 is a perspective drawing of sliding sleeves of the flower-structured, dynamic, decorative lamp of the present invention.

Referring to FIG. 2, preferably, the sliding sleeve 136 at least comprises a sliding sleeve 136 connected to the outer-layer petal structure and sliding sleeve 136 connected to the inner-layer petal. The sliding sleeve 136 connected to the inner-layer petal structure and the sliding sleeve 136 connected to the outer-layer petal structure are connected. The sliding sleeve 136 connected to the outer-layer petal structure can be connected to the sliding rod 108. The sliding arm at least comprises a first sliding arm 104 hinged at the sliding sleeve 136 connected to the outer-layer petal structure and a second sliding arm 102 hinged at the sliding sleeve 136 connected to the inner-layer petal. In the process of simulation of a blooming flower, the first sliding arms 104 change the included angle they form with the petal posing mechanism 106 so that the restriction provided by the first petal-shaped tabs 105 to the second petal-shaped tabs 103 attached to the second sliding arms 102 changes.

Preferably, the petal posing mechanism 106 is connected to the damper device through the stem 107. The stem 107 defines a space for accommodating the sliding rod 108. The stem 107 remains connected with the damper device or the power transmission device when the damper device or the power transmission device drives the sliding rod 108 to move, so that relative displacement happens between the sliding rod 108 and the petal posing mechanism 106.

Figure 3:
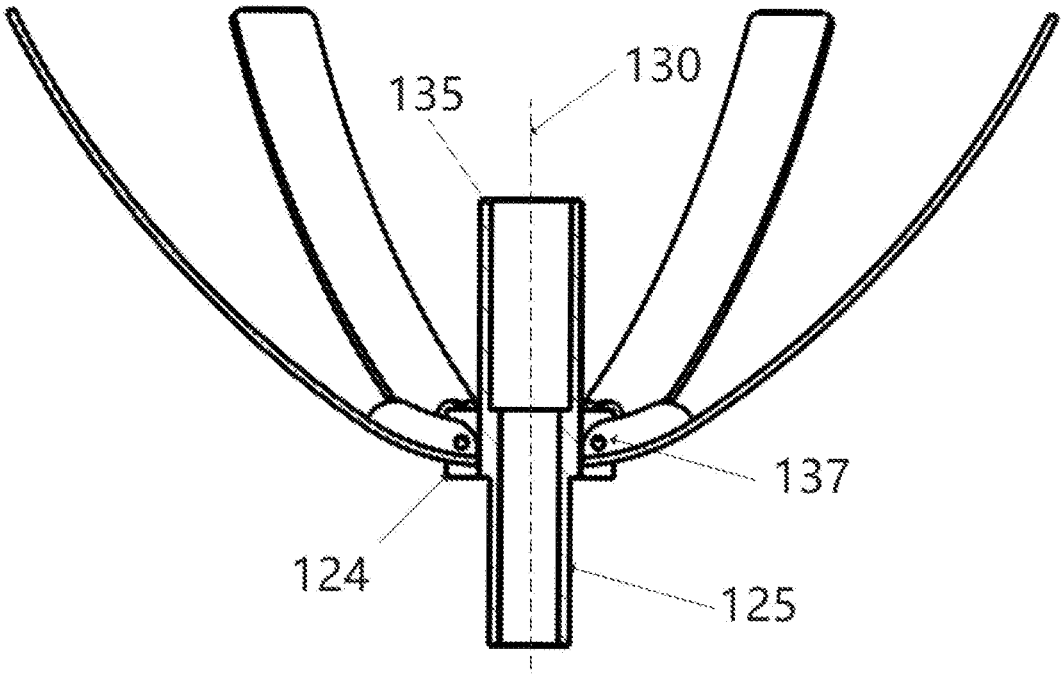
FIG. 3 is a simplified cross-sectional view of the sliding sleeve of the present invention.

Referring to FIG. 2 and FIG. 3, the sliding sleeve 136 is formed by a sleeving section 125, a pivot section 124, and an upper connector 135 arranged along the axis Z 130. The pivot section 124 connects plural first sliding arms 104 or plural second sliding arms 102. The plural first sliding arms 104 or the plural second sliding arms 102 are connected to the pivot section 124, wherein the first sliding arm 102 or the second sliding arm 104 has a first sliding arm connector 134 or a second sliding arm connector 132 in the form of being arranged coplanarly and separated by an angle from each other to the pivot section 124 of the sliding sleeve 136 through a restricting member 137, so as to form the outer-layer petal structure or the inner-layer petal structure. The upper connector 135 of the sliding sleeve 136 in the inner-layer petal structure is for receiving the lamp bead 101, and the sleeving section 125 of the sliding sleeve 136 in the inner-layer petal structure is connected to the upper connector 135 of the sliding sleeve 136 in the outer-layer petal structure, so that the lamp bead 101, the outer-layer petal structure, and the inner-layer petal structure jointly form a flower-like structure. The sleeving section 125 of the sliding sleeve 136 in the outer-layer petal structure is for receiving the damper device or the power transmission device, so that the damper device or the power transmission device drives the sliding sleeve 136 to move along the axis Z 130. Preferably, the damper device is connected to the sleeving section 125 of the sliding sleeve 136 in the outer-layer petal structure through the sliding rod 108.

When the damper device drives the two sliding sleeves 136 to move along the axis Z 130, the first sliding arm 104 is hinged at one end of the pivot section 124, i.e., the first sliding arm connector 134, moves with the sliding sleeve 136, while the free end of the first sliding arm 104 move in a direction opposite to the sliding sleeve 136. Therefore, change of an included angle between each said first sliding arm 104 and the petal posing mechanism 106 in a plane defined by a contact point therebetween and the axis Z 130 and change of a position of each said first petal-shaped tab 105 connected with a respective said sliding arm 104 happen, and they can jointly allow the outer-layer petal structure to simulate opening and closing actions of outer-layer petals of a real-world flower.

Figure 4:
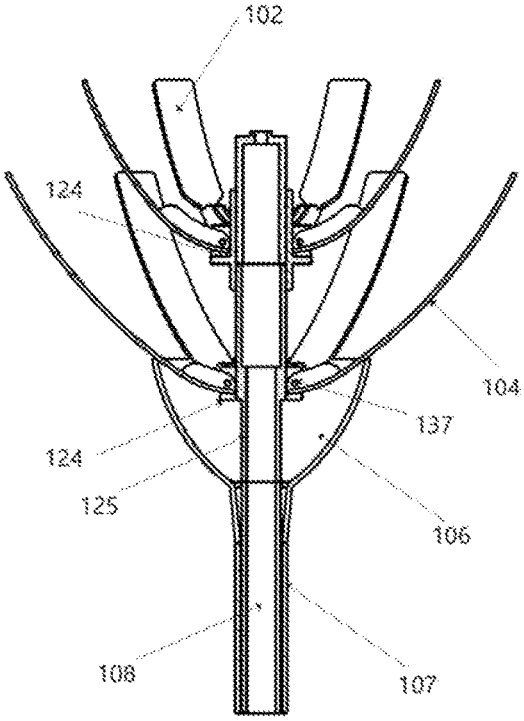
FIG. 4 is a simplified cross-sectional view of the flower-structured, dynamic, decorative lamp in the flower-simulating open state.

Referring to FIG. 4, preferably, the damper device drives the sliding sleeve 136 in the outer-layer petal structure to move away from the petal posing mechanism 106 through the sliding rod 108, thereby simulating a blooming flower. Preferably, in the process of simulation of a blooming flower, the included angle between the first sliding arms 104 and the sliding sleeve 136 to which they are hinged increases so that the hinge point comes close to the periphery of the petal posing mechanism 106. Preferably, the first sliding arms 104 use their contact with the periphery of the petal posing mechanism 106 to resist the gravitational effects of the outer-layer petal structure itself, thereby preventing the outer-layer petal structure from over-dropping.

Preferably, the second sliding arms 102 can drop by gravity. Limited by the step provided on the sliding sleeve 136 to which they are hinged, the separation level between the second sliding arms 102 and the sliding sleeve 136 is smaller than 90 degrees.

Figure 5:
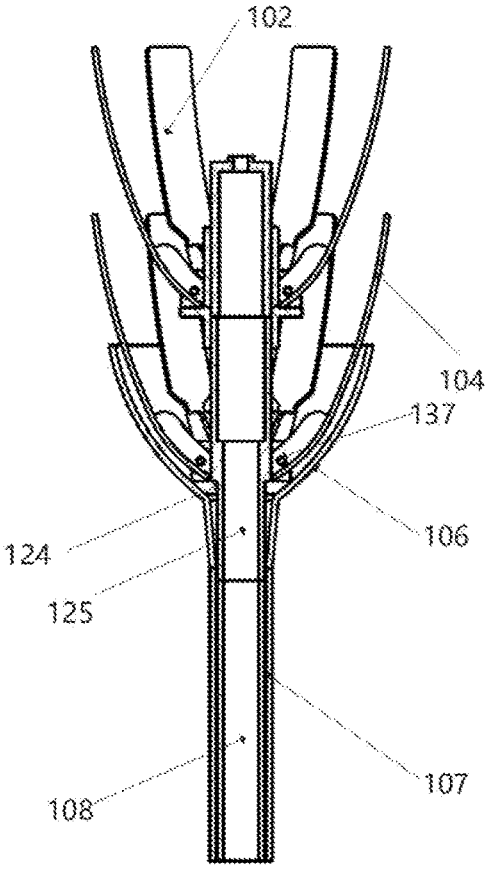
FIG. 5 is a simplified cross-sectional view of the flower-structured, dynamic, decorative lamp in the flower-simulating closed state.

Referring to FIG. 5, preferably, in the process of simulation of gathering of petals of a flower, the damper device drives the sliding sleeve 136 in the outer-layer petal structure to come close to the inner vertex of the petal posing mechanism 106 through the sliding rod 108, thereby simulating the closing action of a flower. The housing and the periphery of the petal posing mechanism 106 force the first sliding arms 104 to rotate about the hinge point between it and the sliding sleeve 136 to reduce the included angle between it and the sliding sleeve 136, thereby reducing the separation level of the outer-layer petal structure. Preferably, when the separation level of the outer-layer petal structure is reduced, the inner-layer petal structure is pressed by the outer-layer petal structure and therefore has its separation level reduced.

Figure 6:
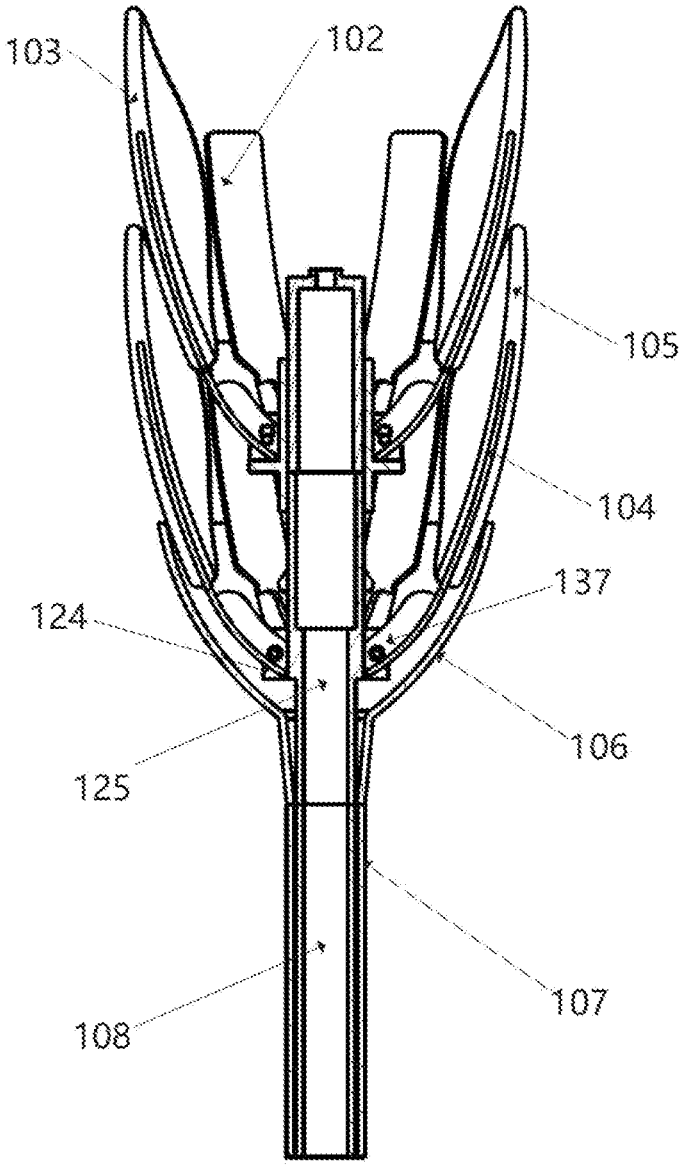
FIG. 6 is similar to FIG. 5, showing petal-shaped tabs attached.

Referring to FIG. 6, preferably, in the process of simulation of closing of a flower, the first petal-shaped tabs 105 of the outer-layer petal structure are in contact with the second petal-shaped tabs 103 of the inner-layer petal structure. In the process where the housing and the periphery of the petal posing mechanism 106 force the first sliding arms 104 to rotate about the hinge point between it and the sliding sleeve 136 to reduce the included angle between it and the sliding sleeve 136, the first petal-shaped tabs 105 attached to the first sliding arms 104 come into contact with the second petal-shaped tabs 103 attached to the second sliding arms 102, and transfer the pushing force they receive from the housing and periphery of the petal posing mechanism 106 to the second petal-shaped tabs 103, thereby forcing the second sliding arms 102 to come close to the sliding sleeve of the inner-layer petal structure, and in turn reducing the separation level of the inner-layer petal structure.

Preferably, the second sliding arm 102 is hinged at one end of the pivot section 124. This makes the second sliding arm connector 132 move with the sliding sleeve 136. When the outer-layer petal structure simulates outer-layer petals of a flower to open and close, the sliding sleeve 136 in the inner-layer petal structure moves with the sliding sleeve 136 in the outer-layer petal structure.

Preferably, in the process where the damper device drives the sliding rod 108 to move, the first sliding arm 104 at least has an open position, an over-blooming position, and a closed position. Preferably, the flower-structured, dynamic, decorative lamp 100 of the present invention is made to simulate the whole process where a bud blooms into a flower. Preferably, when the flower-structured, dynamic, decorative lamp 100 of the present invention simulates a bud, the first sliding arm 104 is in its closed position. When the flower-structured, dynamic, decorative lamp 100 of the present invention simulates the fully bloomed flower, the first sliding arm 104 is in its over-blooming position. Preferably, in the process where the lamp simulates a flower from its bud state to its fully bloomed state, the first sliding arm 104 is in its open position.

Referring to FIG. 1, preferably, the damper device at least comprises a sliding shaft 114, a spring 116, and damping grease 115. Damping grease 115 applied to the surface of the sliding shaft 114 can retard the movement of the sliding shaft 114 when the spring 116 performs restorable deformation, so that the movement of the sliding rod 108 connected with the sliding shaft 114 is limited in speed.

Preferably, the damper device may be connected with the base 121 to support the flower-structured, dynamic, decorative lamp 100. The damper device and the sliding rod 108 are connected together and then enclosed in the casing 110. When the damper device and the base 121 are connected, a protuberance 111 formed on the casing 110 can fit in a recess 119 formed in the socket 120 of the base 121.

Preferably, when the protuberance 111 of the casing 110 fits in the recess 119 of the base 121, a tongue formed on the casing 110 is in contact with a spring sheet 118 installed in the socket 120 of the base 121 to form a feed path, so that the battery box 122 installed inside the base 121 can power the lamp bead 101 installed in the flower-simulating lamp. Preferably, a user may use a switch 123 connected with the battery box 122 to control power supply to the lamp bead 10.

Preferably, the spring 116 in the damper device is connected with an adjusting cap 117. When the damper device is enclosed in the casing 110, the spring 116, the adjusting cap 117, and the casing 110 jointly form a springiness adjusting mechanism for adjusting the initial spring force of the spring 116 in the damper device, thereby being adaptive to operating forces from different users.

Preferably, where a damper device is used to drive the sliding rod 108, the sliding rod 108 at its end close to the damper device is provided with a pressing lever 109 on which a user can exert a force, thereby make the spring 116 perform plastic deformation.

A user may exert a force on the pressing lever 109 to make the sliding rod 108 move away from the sliding sleeve 136 and in turn gather the first sliding arms 104 together. When the spring 116 restores from its elastic deformation, it drives the sliding rod 108 to move toward the sliding sleeve 136. With the effects of the damping grease 115, the sliding rod 108 moves toward the sliding sleeve 136 connected with the outer-layer petal structure slowly and steadily. In the process where the damper device drives the sliding rod 108 to move toward the sliding sleeve 136 connected with the outer-layer petal structure, the first sliding arms 104 move from the closed position to the open position and eventually to the over-blooming position. As a result of the change in position of the first sliding arms 104, the first petal-shaped tabs 105 attached to the first sliding arms 104 lose their restricting effects on the second petal-shaped tabs 103 attached to the second sliding arms 102, so that the second sliding arms 102 and the second petal-shaped tabs 103 attached thereto have displacement due to gravitation, thereby simulating the blooming process of a flower.

Preferably, when a user exerts a force on the pressing lever 109, the sliding rod 108 moves away from the sliding sleeve 136, so that first sliding arms 104 are gathered. The first petal-shaped tabs 105 attached to the first sliding arm 104 come into contact with the second petal-shaped tabs 103 attached to the second sliding arms 102 and force the second petal-shaped tabs 103 to get gathered, resembling the closing action of a flower.

Embodiment 2

Figure 7:
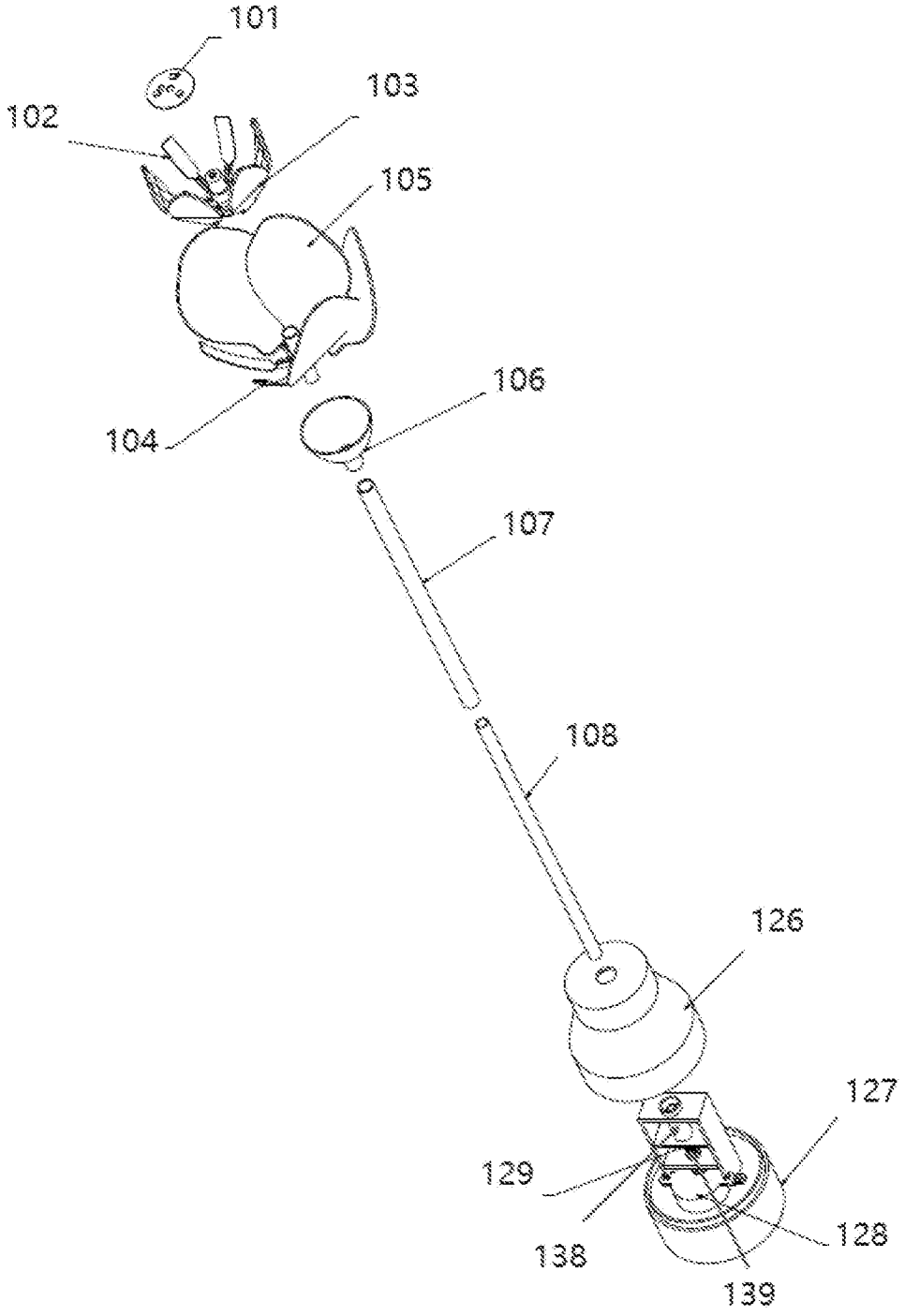
FIG. 7 is an exploded view of a flower-structured, dynamic, decorative lamp having a power transmission device.

The present embodiment provides further improvements to Embodiment 1, and all the details that have been discussed previously will not be repeated herein. Referring to FIG. 7, the present embodiment uses a power transmission device to drive the sliding rods 108.

Preferably, the power transmission device at least comprises an electric motor 128 and a transmission frame 129. The transmission frame 129 is connected to the lower base cover 127. The output shaft of the electric motor 128 is connected to the threaded bar 139. The threaded bar 139 is connected to the sliding nut support 138. The sliding rod 108 and the sliding nut support 138 are connected together to form a lifting structure, so that the sliding rod 108 is endowed with a lifting property. Preferably, the electric motor 128 may be a stepping motor, so that a user can conveniently adjust the rotational speed of the electric motor 128 and the initial postures of the petal-shaped tabs.

Preferably, the electric motor 129 is installed in the lower base cover 127. The electric motor 128 and the transmission frame 129 are connected together to form the power transmission device. The lower base cover 127 is combined with an upper base cover 126 so as to enclose the power transmission device therebetween and support the flower-shaped, dynamic, decorative lamp 100. The petal posing mechanism 106 is connected to the upper base cover 126 (the casing of the power transmission device) through the stem 107.

Preferably, in the present embodiment, after the sliding rod 108 is connected to the power transmission device, a user may control how fast the flower-simulating bloom process of the flower-structured, dynamic, decorative lamp 100 by adjusting the rotational speed of the electric motor. Preferably, the present embodiment uses the power transmission device to drive the flower-structured, dynamic, decorative lamp 100 to adjust the initial postures of the petal-shaped tabs freely. Additionally, when simulating a blooming flower, the present embodiment can provide different blooming speeds by adjusting the rotational speed of the electric motor 128.

Embodiment 3

The present embodiment provides further improvements to Embodiments 1 and 2, and all the details that have been discussed previously will not be repeated herein. Preferably, an electromagnetic levitation device is included to control the first sliding arms 104 and the second sliding arms 102. Preferably, the effects of electromagnetic levitation prevent the second petal-shaped tabs 103 attached to the second sliding arms 102 from posing unnaturally as they become over separated before the first petal-shaped tabs are fully separated and thus failing to simulate the full blooming process of a flower as a result of changing posture under the gravitational effects of the second sliding arms 102 and of the second petal-shaped tabs 103 as well as the restriction from the first petal-shaped tabs 105 attached to the first sliding arms 104.

Preferably, the petal posing mechanism 106 is connected to the damper device or the power transmission device through the stem 107. The stem 107 defines therein a space for accommodating the sliding rod 108. Throughout the process where the damper device or power transmission device drives the sliding rod 108 to move, the stem 107 remains connected with the damper device or power transmission device, so as to achieve relative displacement between the sliding rod 108 and the petal posing mechanism 106.

Preferably, when the sliding rod 108 comes close to the sliding sleeve 136 connected with the outer-layer petal structure, the first sliding arms 104 are switched to the separated state from the gathered state. The first petal-shaped tabs 105 attached to the first sliding arms 104 move with the first sliding arms 104, thereby making the outer-layer petal structure open. When the first petal-shaped tabs 105 start to simulate the opening action of the outer-layer petals of a flower, the first petal-shaped tabs 105 separate from the second petal-shaped tabs 103 attached to the second sliding arm 102, so that the second petal-shaped tabs 103 are released from restriction of the first petal-shaped tabs 105. When becoming independent of the first petal-shaped tabs 105, the second petal-shaped tabs 103 shift from the separated state to the gathered state due to the gravitation of the second sliding arms 102, thereby simulating the opening action of inner-layer petals of a flower.

Preferably, the blooming process of a flower is simulated by at least four successive states, namely (1) the outer-layer petal structure open and the inner-layer petal structure closed, (2) both the outer-layer petal structure and the inner-layer petal structure open, (3) the outer-layer petal structure over open and the inner-layer petal structure normally open, and (4) both the outer-layer petal structure and the inner-layer petal structure over open. Preferably, the four states represent the about-to-bloom state, the early blooming state, the fully blooming state, and the over blooming state of a flower, respectively. Preferably, the present invention uses an electromagnetic levitation device to control the first sliding arms 104 and the second sliding arms 102 to simulate different blooming states of a flower.

Preferably, the blooming state of a flower is implemented as below. The electromagnetic levitation device sizes a magnetic force it applies to the second sliding arms 102 according to the position of the first sliding arms 104, so as to control the states of the second petal-shaped tabs 103, thereby simulating different blooming states of a flower.

Preferably, when simulating the about-to-bloom state of a flower, that is, when the present invention simulates the state that the outer-layer petal structure open and the inner-layer petal structure closed, the first sliding arms 104 shift to the open position from the closed position. When the first sliding arms 104 are in their open position, the electromagnetic levitation device is in its first state in which it holds the second sliding arms 102 still. In its first state, the electromagnetic levitation device generates a levitation force that is sufficient to cancel the acting force that makes the second sliding arms 102 and the second petal-shaped tabs 103 enter the open state from the closed state. Preferably, the acting force that makes the second sliding arms 102 and the second petal-shaped tabs 103 enter the open state from the closed state or makes the second sliding arms 102 and the second petal-shaped tab 103 move is the component force of its gravitation in its moving direction.

Preferably, when simulating the early blooming state of a flower, that is, when the present invention simulates the state that both the outer-layer petal structure and the inner-layer petal structure open, the first sliding arms 104 are in their open position, and the electromagnetic levitation device is in its second state. Preferably, in its second state, the electromagnetic levitation device first reduces the levitation force it generates so that the levitation force is smaller than the acting force that makes the second sliding arms 102 and the second petal-shaped tabs 103 enter the open state from the closed state, thereby allowing the second petal-shaped tabs 103 to enter the open state from the closed state. Preferably, before the second petal-shaped tabs 103 enter the open state, the electromagnetic levitation device increases the levitation force it generates to cancel the acting force that makes the second sliding arms 102 and the second petal-shaped tabs 103 move, and when the second petal-shaped tabs 103 enter the open state, the electromagnetic levitation device increases the levitation force it generates so that the second petal-shaped tabs 103 can stop at the open position.

Preferably, when simulating a fully blooming state of a flower, that is, when the present invention simulates the state that the outer-layer petal structure over open and the inner-layer petal structure normally open, the first sliding arms 104 shift from the open position to the over-blooming position. For the disclosed lamp to simulate a fully blooming flower, the electromagnetic levitation device is in its third state. At this time, the levitation force generated by the electromagnetic levitation device can cancel the acting force that makes the second sliding arms 102 and the second petal-shaped tabs 103 move, thereby allowing the second petal-shaped tabs 103 to keep the open state.

Preferably, when simulating the over blooming state of a flower, that is, when the present invention simulates the state that both the outer-layer petal structure and the inner-layer petal structure over open, the first sliding arms 104 are in the over-blooming position. At this time, the electromagnetic levitation device is in its fourth state. Preferably, in its fourth state, the electromagnetic levitation device generates a reduced levitation force, so that the second petal-shaped tabs 103 enter the over-open state form the open state.

Preferably, the electromagnetic levitation device adjusts the levitation force by detecting the position of the first sliding arms 104, so as to control the position of the second petal-shaped tabs 103, thereby simulating different blooming states of a flower.

It should be noted that the above-mentioned specific embodiments are exemplary, and those skilled in the art can come up with various solutions inspired by the disclosure of the present invention, and those solutions also fall within the disclosure scope as well as the protection scope of the present invention. It should be understood by those skilled in the art that the description of the present invention and the accompanying drawings are illustrative rather than limiting to the claims. The protection scope of the present invention is defined by the claims and their equivalents. The description of the present invention contains a number of inventive concepts, such as "preferably", "according to a preferred embodiment" or "optionally", and they all indicate that the corresponding paragraph discloses an independent idea, and the applicant reserves the right to file a divisional application based on each of the inventive concepts.

What is claimed is:

1. A flower-structured, dynamic, decorative lamp, comprising at least two layers of petal structures arranged as an inner layer and an outer layer and at least one lamp bead, wherein, when an inner-layer petal structure is closed, the lamp bead is enclosed radially inside the inner-layer petal structure, and wherein, the at least two layers of petal structures are mounted around a stem via respective sliding sleeves in a manner that the at least two layers of petal structures are coaxial about an axis Z and allowed to slide upward and downward, in which when the at least two layers of petal structures are assembled, first sliding sleeve of an inner-layer petal structure is located above second sliding sleeve of an outer-layer petal structure in a direction of the axis Z, wherein, a petal posing mechanism is mounted around the stem coaxially with the respective sliding sleeves of the at least two layers of petal structures about the axis Z such that the petal posing mechanism axially upward resists gravitation of the at least two layers of petal structures, wherein the petal posing mechanism changes a separation level of all petals hinged at the second sliding sleeve of at least the outer-layer petal structure by sliding along the stem with respect to the second sliding sleeve of the outer-layer petal structure, wherein relative sliding between the petal posing mechanism and the respective sliding sleeves is driven by a damper device or a power transmission device, wherein, the outer-layer petal structure is formed by connecting a plurality of first sliding arms connected with first petal-shaped tabs to the first sliding sleeve; and the inner-layer petal structure is formed by connecting a plurality of second sliding arms connected with second petal-shaped tabs to another said sliding sleeve; and the petal posing mechanism is a hemispherical housing, and has its periphery contacting a middle portion of each said first sliding arm while having its vertex provided with a through hole for enabling connection between the sliding sleeve of the outer-layer petal structure and the damper device or a power transmission device that powers simulation of blooming dynamics of a real-world flower;

and wherein, the damper device or the power transmission device is configured to drive the first sliding sleeve and second sliding sleeve to move away from the petal posing mechanism along the axis Z when the flower-structured, dynamic, decorative lamp is performing a simulation of blooming.

2. The flower-structured, dynamic, decorative lamp of claim 1, wherein each of the first sliding sleeve and the second sliding sleeves is formed by a sleeving section, a pivot section and an upper connector, which are arranged along the axis Z successively, wherein, the plurality of first sliding arms or the plurality of second sliding arms are connected to the pivot section, wherein the plurality of first sliding arms or the plurality of second sliding arms have first sliding arm connectors or second sliding arm connectors hinged in a form of being arranged coplanarly and separated by an angle from each other to the pivot section of the sliding sleeve through a restricting member, so as to form the outer-layer petal structure or the inner-layer petal structure;

the upper connector of the sliding sleeve in the inner-layer petal structure is for receiving the lamp bead, and the sleeving section of the sliding sleeve in the inner-layer petal structure is connected to the upper connector of the sliding sleeve in the outer-layer petal structure, so that the lamp bead, the outer-layer petal structure, and the inner-layer petal structure jointly form a flower-like structure; and the sleeving section of the sliding sleeve in the outer-layer petal structure is for receiving the damper device or the power transmission device, so that the damper device or the power transmission device drives the sliding sleeve to move along the axis Z.

3. The flower-structured, dynamic, decorative lamp of claim 2, wherein the first sliding arms are hinged at one end of the pivot section when the damper device or the power transmission device drives the first sliding sleeve and the second sliding sleeves to move along the axis Z, so that the first sliding arm connectors move with the first sliding sleeve and the second sliding sleeve while free ends of the first sliding arms move reversely to the first sliding sleeve and the second sliding sleeve, leading to change of an included angle between each said first sliding arm and the petal posing mechanism in a plane defined by a contact point therebetween and the axis Z, and leading to change of a position of each of the first petal-shaped tabs connected with a respective said sliding arm, thereby allowing the outer-layer petal structure to simulate opening and closing actions of outer-layer petals of a real-world flower.

4. The flower-structured, dynamic, decorative lamp of claim 3, wherein the second sliding arm is such hinged at one end of the pivot section that a second sliding arm connector moves with the sliding sleeve, so that when the outer-layer petal structure simulates the opening and closing actions of outer-layer petals of a real-world flower, the sliding sleeve in the inner-layer petal structure moves with the sliding sleeve in the outer-layer petal structure.

5. The flower-structured, dynamic, decorative lamp of claim 4, wherein the petal posing mechanism is connected to a casing of the damper device or the power transmission device through the stem, and the damper device or the power transmission device is connected to the sliding sleeve in the outer-layer petal structure through a sliding rod; and the stem defines a space for accommodating the sliding rod, and remains connected with the damper device or the power transmission device when the damper device or the power transmission device drives the sliding rod to move, so that relative displacement happens between the sliding rod and the petal posing mechanism.

6. The flower-structured, dynamic, decorative lamp of claim 5, wherein the damper device at least comprises a sliding shaft, a spring and damping grease, wherein the damping grease applied to a surface of the sliding shaft serves to retards movement of the sliding shaft when the spring performs restorable deformation, so that the sliding rod connected with the sliding shaft has its movement limited in speed; and the spring is connected with an adjusting cap, so that when the casing encloses the damper device, the spring, the adjusting cap, and the casing jointly form a springiness adjusting mechanism for adjusting an initial spring force of the spring of the damper device.

7. The flower-structured, dynamic, decorative lamp of claim 6, wherein the power transmission device at least comprises an electric motor and a transmission frame, in which the transmission frame is connected with a lower base cover, and the electric motor has its output shaft connected with a threaded bar which is further connected with a sliding nut support, while the sliding rod is connected to the sliding nut support so as to form a lifting structure that endows the sliding rod with a lifting property.

8. The flower-structured, dynamic, decorative lamp of claim 7, wherein the damper device is connected to a base to support the flower-structured, dynamic, decorative lamp, in which the damper device and the sliding rod are connected together and then enclosed inside the casing, so that with the damper device connected to the base, a protuberance provided on the casing gets engaged with a recess in a socket provided on the base.

9. The flower-structured, dynamic, decorative lamp of claim 8, wherein the electric motor is installed in the lower base cover and connected to the transmission frame to jointly form the power transmission device, and the lower base cover is connected to an upper base cover to enclose the power transmission device and support the flower-structured, dynamic, decorative lamp.

10. An openable and closable flower-structured light-emitting device comprising a plurality of sliding arms for driving a plurality of petal-shaped tabs and a sliding support for mounting the plurality of sliding arms, wherein at least three of the plurality of sliding arms are hinged at a pivot section of the sliding support through a restricting member in a form of being separated by an angle from each other, and wherein in a case of simulating an opening of a petal structure comprising the plurality of petal-shaped tabs, the plurality of sliding arms configured to change the angle made with a limiting rest by movement of a sliding rod connected to the sliding support in a direction of its own axis to cause the petal structure to move away from a petal posing mechanism along an axis Z when a flower-structured light-emitting device performs a simulation of blooming, wherein one end of the sliding rod is connected to a sleeving section of the sliding support and the other end is connected to a damper device or a power transmission device that drives the sliding rod pass through a center of the limiting rest to move the sliding support, and wherein the petal posing mechanism is a hemispherical housing, and has a periphery contacting a middle portion of each of the plurality of sliding arms while having a vertex provided with a through hole for enabling connection between the sleeving section and the damper device or the power transmission device.

11. The openable and closable flower-structured light-emitting device according to claim 10, wherein the sliding support comprises at least a first sliding support and a second sliding support, wherein the second sliding support is connected to the first sliding support, and the first sliding support can be connected to the sliding rod; the plurality of sliding arms comprises at least a first sliding arm hinged on the first sliding support and a second sliding arm hinged on the second sliding bracket; in a case of performing the simulation of blooming, the first sliding arm changes the angle made with the limiting rest so that a restriction of first petal-shaped tabs mounted on the first sliding arm to second petal-shaped tabs mounted on the second sliding arm is changed.

12. The openable and closable flower-structured light-emitting device of claim 11, wherein the limiting rest is connected to a casing of the damper device or the power transmission device through a stem, and the stem defines a space for accommodating the sliding rod, and remains connected with the damper device or the power transmission device when the damper device or the power transmission device drives the sliding rod to move, so that relative displacement happens between the sliding rod and the limiting rest.

13. The openable and closable flower-structured light-emitting device of claim 12, wherein the damper device at least comprises a sliding shaft, a spring, and damping grease, wherein the damping grease applied to a surface of the sliding shaft serves to retards movement of the sliding shaft when the spring performs restorable deformation, so that the sliding rod connected with the sliding shaft has its movement limited in speed.

14. The openable and closable flower-structured light-emitting device of claim 13, wherein the power transmission device at least comprises an electric motor and a transmission frame, in which the transmission frame is connected with a lower base cover, and the electric motor has its output shaft connected with a threaded bar which is further connected with a sliding nut support, while the sliding rod is connected to the sliding nut support so as to form a lifting structure that endows the sliding rod with a lifting property.

15. The openable and closable flower-structured light-emitting device of claim 14, wherein the damper device is connected to a base to support a flower-structured, dynamic, decorative lamp, wherein the damper device and the sliding rod are connected together and then enclosed inside the casing, so that with the damper device connected to the base, a protuberance provided on the casing gets engaged with a recess in a socket provided on the base.

16. The openable and closable flower-structured light-emitting device of claim 15, in the case that a protuberance provided on the casing gets engaged with a recess provided on the base, a tongue provided on the casing contacts a spring sheet installed in the socket of the base to form a feed path, enabling a battery box installed inside the base to supply power to a light source set on the flower-structured, dynamic, decorative lamp.

17. The openable and closable flower-structured light-emitting device of claim 16, wherein the spring mounted on the damper device is connected with an adjusting cap, so that when the casing encloses the damper device, the spring, the adjusting cap, and the casing jointly form a springiness adjusting mechanism for adjusting an initial spring force of the spring of the damper device.

18. The openable and closable flower-structured light-emitting device of claim 17, wherein the electric motor is installed in the lower base cover and connected to the transmission frame to jointly form the power transmission device, and the lower base cover is connected to an upper base cover to enclose the power transmission device and support the flower-structured, dynamic, decorative lamp.

19. The openable and closable flower-structured light-emitting device of claim 18, wherein in the case that the damper device is employed to drive the sliding rod, the sliding rod is provided at an end close to the damper device with a pressing lever that transmits a force applied by a user to cause an elastic deformation of the spring.

* * * * *